US010066456B2

(12) United States Patent
Berryhill

(10) Patent No.: US 10,066,456 B2
(45) Date of Patent: Sep. 4, 2018

(54) WELL ASSEMBLY WITH SELF-ADJUSTING LOCKDOWN ASSEMBLY

(71) Applicant: OneSubsea IP UK Limited, London (GB)

(72) Inventor: Benjamin Scott Berryhill, Houston, TX (US)

(73) Assignee: OneSubsea IP UK Limited, London (GB)

( * ) Notice: Subject to any disclaimer, the term of this patent is extended or adjusted under 35 U.S.C. 154(b) by 238 days.

(21) Appl. No.: 15/060,361

(22) Filed: Mar. 3, 2016

(65) Prior Publication Data

US 2017/0254166 A1 Sep. 7, 2017

(51) Int. Cl.

| | |
|---|---|
| ***E21B 33/038*** | (2006.01) |
| ***E21B 33/043*** | (2006.01) |
| ***E21B 33/035*** | (2006.01) |
| *E21B 23/01* | (2006.01) |

(52) U.S. Cl.

CPC ..... *E21B 33/038* (2013.01); *E21B 33/035* (2013.01); *E21B 33/043* (2013.01); *E21B 23/01* (2013.01)

(58) Field of Classification Search

CPC ..... E21B 33/043; E21B 33/04; E21B 33/038; E21B 33/035

See application file for complete search history.

(56) References Cited

U.S. PATENT DOCUMENTS

| | | | |
|---|---|---|---|
| 5,327,965 | A | 7/1994 | Stephen et al. |
| 8,662,189 | B2 | 3/2014 | Harsono et al. |
| 8,844,623 | B2 | 9/2014 | Nguyen |
| 2004/0238175 | A1 | 12/2004 | Wade et al. |
| 2005/0167118 | A1 | 8/2005 | Fenton et al. |
| 2006/0191680 | A1 | 8/2006 | Nelson |
| 2013/0213661 | A1 | 8/2013 | Reimert et al. |
| 2013/0213671 | A1 | 8/2013 | Reimert et al. |

FOREIGN PATENT DOCUMENTS

| | | | |
|---|---|---|---|
| EP | 0137335 | A2 | 4/1985 |
| WO | 2009126420 | A1 | 10/2009 |

OTHER PUBLICATIONS

International Search Report and Written Opinion issued in corresponding application No. PCT/EP2017/051189 dated Apr. 4, 2017, 12 pgs.

*Primary Examiner* — Giovanna C. Wright
*Assistant Examiner* — Kristyn A Hall
(74) *Attorney, Agent, or Firm* — Chamberlain Hrdlicka

(57) ABSTRACT

A self-adjusting lockdown assembly for engaging and/or preloading a tubular hanger to an interior of a wellhead housing. The lockdown assembly includes a support sleeve, a body received in the support sleeve, an elevator ring coaxially engaged with the support sleeve, a lock ring engaged with the elevator ring, and an actuator sleeve configured to move axially between the body and the elevator ring so as to adjust the position of the lock ring.

17 Claims, 10 Drawing Sheets

WELL ASSEMBLY WITH SELF-ADJUSTING LOCKDOWN ASSEMBLY

BACKGROUND

This section is intended to provide background information to facilitate a better understanding of the various aspects of the described embodiments. Accordingly, it should be understood that these statements are to be read in this light and not as admissions of prior art.

In drilling and completing wells, such as for mineral (e.g., oil and gas) extraction systems and/or for fluid transport systems, casing hangers are designed to support the weight of associated casing strings by landing on a seat within a wellhead housing. The casing hanger is then locked in position by urging a split ring carried on a lockdown sleeve into a recess on the interior wall of the wellhead housing to prevent upward movement of the casing hanger. The lockdown sleeve can be installed on top of the casing hanger inside the wellhead housing, to resist upward thrust loads caused by thermal expansion of the casing string and annulus pressure buildup around the casing string. Some lockdown sleeves require running a measurement tool, such as a lead impression tool, into the wellhead housing to determine the spacing between the casing hanger and the wellhead housing, so that the lockdown sleeve can be adjusted to securely fit the recesses in the wellhead housing. Determining this spacing may require a costly trip in and out of the wellhead housing such as through a riser pipe prior to running the lockdown sleeve.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION

Figure 1:
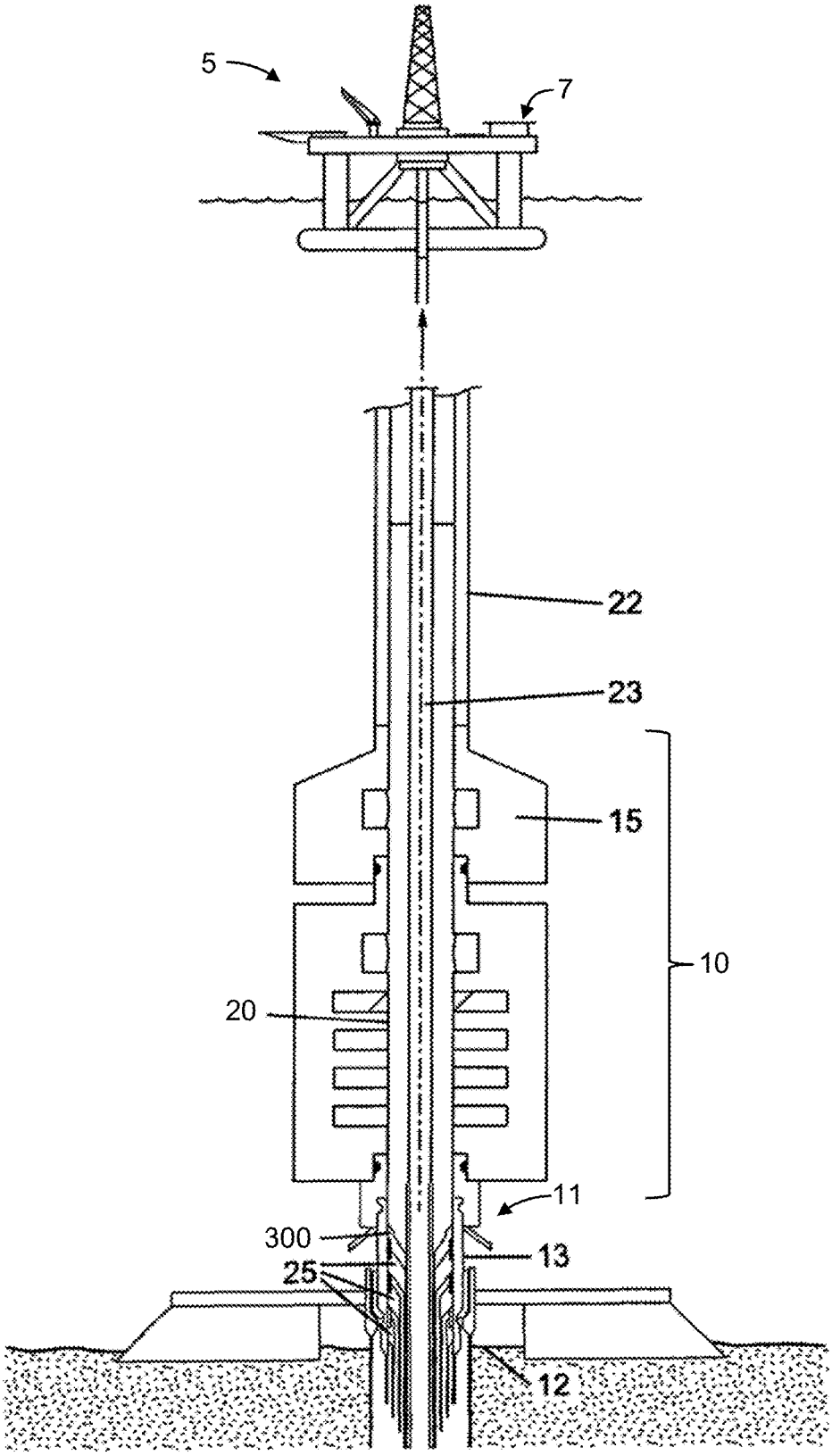
FIG. 1 provides a cross-sectional schematic of an exemplary well system and wellhead assembly in which embodiments of the lockdown assembly of the present disclosure may be employed.

One or more specific embodiments of the present disclosure will be described below. These described embodiments are only exemplary of the present disclosure. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The drawing figures are not necessarily to scale. Certain features of the embodiments may be shown exaggerated in scale or in somewhat schematic form, and some details of conventional elements may not be shown in the interest of clarity and conciseness. Although one or more embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure, the articles "a," "an," and "the" are intended to mean that there are one or more of the elements. The terms "comprising," "including," and "having" are used in an open-ended fashion, and thus should be interpreted to mean "including, but not limited to . . . ." Any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," "upper," "lower," "up," "down," "vertical," "horizontal," "first," "second," "inner," "outer," and variations of these terms or like terms is made for convenience but does not require or imply any particular orientation, number, or relative prominence of these components.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

As discussed in detail below, embodiments of the present disclosure are directed to a self-adjusting lockdown assembly and a method for hanging and securing tubulars (e.g., a casing string or a tubing string) from a wellhead assembly in a wellbore. The disclosure provides a lockdown assembly including a mechanism to secure a hanger (e.g., a casing hanger or a tubing hanger) to an interior of a housing. As will be described, the disclosure includes, for example and without limitation, a lockdown assembly with an actuator ring that can stroke downward to wedge out a split lock ring into receiving groove(s) in a housing and then engages two elevator rings, causing them to rotate in opposite directions about a center axis, which in turn causes the split lock ring to rise until it stops hard against the groove(s) in the housing, thus adjusting the lockdown sleeve against the housing.

FIG. 1 schematically depicts an example well system 5 in which embodiments of the present disclosure may be employed. The well system 5 includes a blowout preventer (BOP) stack assembly 10 and wellhead assembly 11 at the upper end of a wellbore into the earth surface or seabed 12. A bore 20 extends through the BOP stack assembly 10. The lower end of the BOP stack assembly 10 is connected to the upper end of the wellhead assembly 11 and is sealed in place. A marine riser pipe 22 may be connected to a lower marine riser package (LMRP) 15 to place the BOP stack assembly 10 in fluid communication with an offshore vessel 7, for example a floating production storage and offloading (FPSO) unit, ship, platform, floating platform, or the like.

Within the bore 20 of the BOP stack assembly 10, a tubular string 23 is provided. The tubular string 23 may incorporate a number of different types of components, including simple piping, joint members, and/or bore guidance equipment, and may have attached at its lower end additional components, for example a test tool, a drill bit, or a simple device which allows the circulation or the flow of desired fluids through the well. Alternatively, the tubular string 23 may include casing string, tubing string, coiled tubing, wire line, cables, or other components which are necessary to pass through the BOP stack assembly 10 and into the wellhead assembly 11.

As shown, the wellhead assembly 11 may include a wellhead housing 13 having one or more hangers 25 (e.g., casing hangers) set therein and extending into the wellbore in the earth surface or seabed 12. As illustrated, the lockdown assembly 300 of the present disclosure is installable on top of the hangers 25 and may be configured to engage recesses (not shown in FIG. 1) on the interior surface of the wellhead housing 13. In one or more embodiments, the lockdown assembly 300 may include a mechanism, described in detail below, to adjust its height between the hangers 25 and the recesses of the wellhead housing 13 while the lockdown assembly 300 is deployed in the wellhead housing 13. Although FIG. 1 shows a subsea well, it will be appreciated that the lockdown assembly 300 may also be used with surface wells. It will also be appreciated that the mechanism of the lockdown assembly 300 may be used to lock down a variety of components to other components, for example with subsea or surface trees, spools, or adapters to lock down tubing hangers, and with wellhead housings to lock down wellhead housings to conductor housings.

Figure 2:
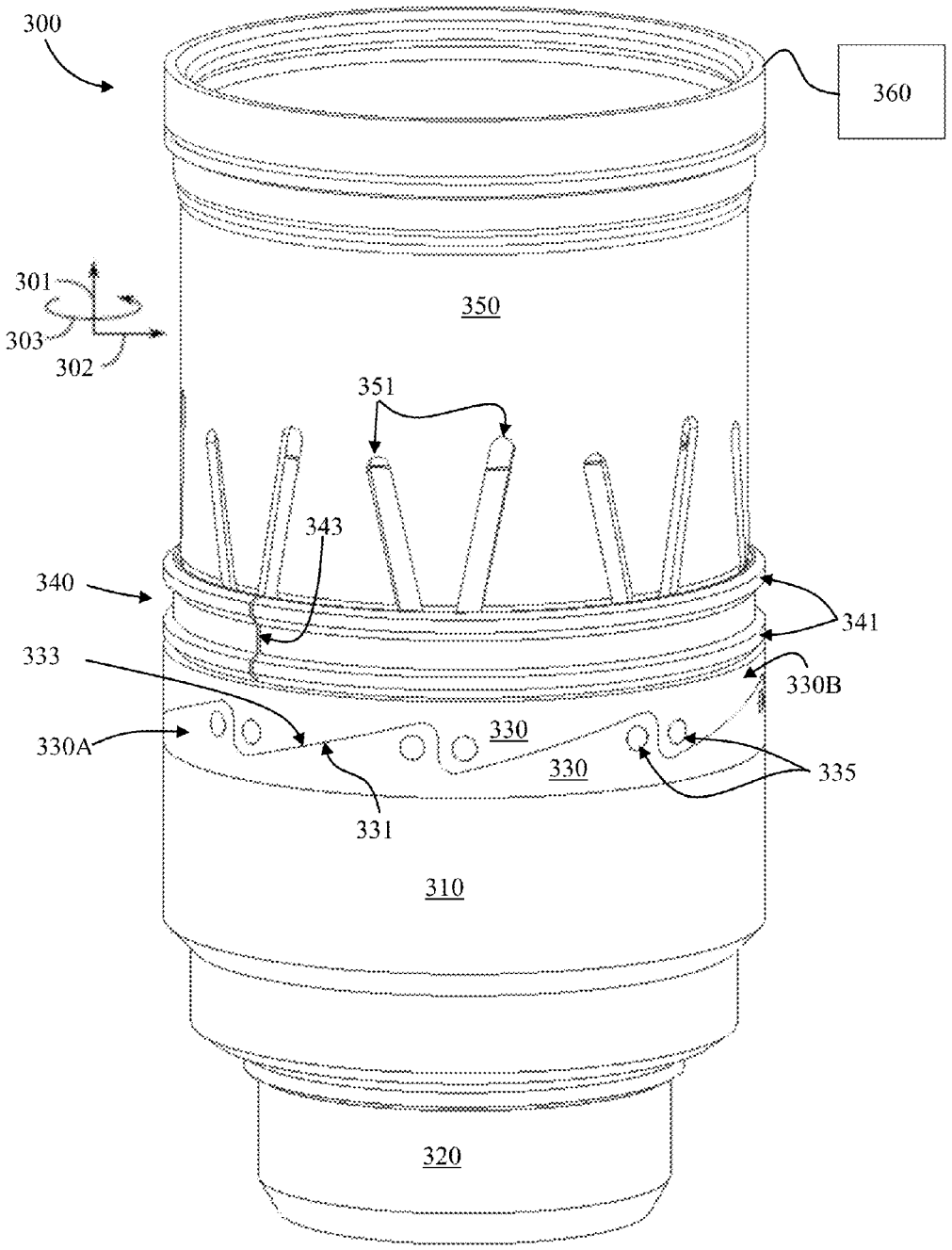
FIG. 2 depicts an axonometric view of a lockdown assembly including a lock ring in an initial position, according to one more embodiments of the present disclosure.

FIG. 2 depicts an axonometric view of the lockdown assembly 300 configured to adjust its height in accordance with one or more embodiments of the present disclosure. The lockdown assembly 300 includes a support sleeve 310 to land in a housing, an internal body 320 (such as a tubular body) to be received in the support sleeve 310, one or more elevator rings 330 (330A, 330B), a lock ring 340 to engage the interior of the housing (such as the wellhead housing 13 of FIG. 1), and an actuator sleeve 350 configured to move axially between the internal body 320 and at least one of the elevator rings 330 so as to adjust the position of the lock ring 340. Optionally, the support sleeve 310 may be integral with the internal body 320.

FIGS. 2-3 and 5-6 show the actuator sleeve 350 in various positions to adjust the spacing between the lock ring 340 and the support sleeve 310 to securely engage the lock ring 340 to the interior of any suitable housing (not shown in FIGS. 2-3 and 5-6), such as the wellhead housing 13 of FIG. 1. As further described in reference to each of FIGS. 2-3 and 5-6 below, in operation the actuator sleeve 350 moves in a downward, axial movement to rotate the elevator rings 330, the relative rotation of which elevates the lock ring 340 away from the support sleeve 310. It will be appreciated that the self-adjusting lockdown assembly 300 can be used as a preloading mechanism in subsea or surface wellheads and trees, or in other preloading applications.

Referring to FIG. 2, the actuator sleeve 350 may be forced toward the support sleeve by a force applied to the top of the actuator sleeve by a separate device or tool (not shown), such as a running tool, a tool having a piston to convert pressure to applied force, and/or any tool that can apply a weight or a downward force on top of the actuator sleeve 350. For example, a power supply 360 may apply a force to the actuator sleeve 350 to move the actuator sleeve in a vertical or longitudinal axial direction, as will be described in further detail below. The power supply 360 may include a fluid reservoir under hydrostatic pressure, a hydraulic motor or system, a pneumatic motor or system, an electric motor or system, an actuatable piston, and/or a combination thereof. For example, in embodiments, the power supply 360 can apply a force to the top of the actuator sleeve 350 by actuating a piston under hydraulic pressure to convert the pressure to an applied force on the actuator sleeve 350. In embodiments, the piston may be actuated electrically. In embodiments, the power supply 360 may include a mass selectively released by a fastener (e.g., shear pins, collet, J-Slots, metered hydraulic time releases, or any other suitable latching mechanism) or control valve. The mass may have a suitable weight to apply a force to move the actuator sleeve 350 in a vertical or longitudinal axial direction, as described further below.

The elevator rings 330A, 330B may be coaxially positioned between the support sleeve 310 and the lock ring 340. The elevator ring 330A may be coupled to or otherwise engaged with the support sleeve 310 and the elevator ring 330B, while the elevator ring 330B may be coupled to or otherwise engaged with the elevator ring 330A and the lock ring 340. In embodiments, the elevator ring 330A may include one or more cams 331 (such as the cylindrical cams illustrated in FIG. 2), while the elevator ring 330B may include one or more followers 333 (such as the cylindrical followers illustrated in FIG. 2). Each cam 331 may include any device suitable to transform a rotary motion into a linear motion along the longitudinal axis of the lockdown assembly 300.

In the following discussion, reference may be made to various directions or axes, such as a y-axis or direction 301, an x-axis or direction 302, or a z-axis or direction 303, as represented schematically on FIGS. 2-3 and 5-10. As used herein, the longitudinal axis of the lockdown assembly 300 refers to an axial direction parallel with the y-axis 301; the x-axis 302 represents an axial direction that is perpendicular to the y-axis and longitudinal axis of the lockdown assembly 300; and the z-axis 303 represents an angular or rotational (clockwise or counterclockwise) direction or orientation about the y-axis 301 or the longitudinal axis of the lockdown assembly 300.

Each follower 333 may include any device suitable to operate along the surface of the cam 331 to transform a rotary motion into a linear motion along the longitudinal axis of the lockdown assembly 300. In one or more embodiments, the rotary motion may include rotating at least one of the cams 331 and the followers 333. In one or more embodiments, the linear motion produced by the cams 331 and the followers 333 may include moving axially away from or toward the support sleeve 310.

Each cam 331 on the elevator ring 330A may include a ramp or angled portion contoured or configured to match or mirror (e.g., have similar but inverse angle or shape as) a follower 333 on the elevator ring 330B. Likewise, each follower 333 on the elevator ring 330B may include a ramp or angled portion contoured or configured to match or mirror (e.g., have similar but inverse angle, shape, or feature as) a cam 331 on the elevator ring 330A. Additionally or optionally, the angled portion of each follower 333 need not match or mirror its corresponding cam 331; further, the cams 331 need not be identical to each other, and the followers 333 need not be identical to each other. As examples, the cams 331 and the followers 333 may be rounded or edged waveforms on the elevator rings 330. In certain embodiments, the angles of the cams 331 and/or the followers 333 may be, for example, between approximately 0 degrees and 90 degrees, 0 degrees and 45 degrees, 0 degrees and 30 degrees, 1 degree and 20 degrees, or 2 degrees and 10 degrees from an x-axis 302 perpendicular to the y-axis 301 or longitudinal axis of the lockdown assembly 300. In other embodiments, the cams 331 and the followers 333 may have any angle suitable to transform a rotary motion (e.g., in the angular direction 303) produced by the actuator sleeve 350 into a linear motion along the longitudinal axis of the lockdown assembly 300 (e.g., along the y-axis 301).

Further, each elevator ring 330 may include one or more actuator pins 335. Each actuator pin 335 may be a pin, a peg, a bolt, a rod, or any other protrusion that extends radially inward from an interior surface of the elevator ring 330. The actuator sleeve 350 may include one or more grooves 351 configured to receive an actuator pin 335. In one or more embodiments, the grooves 351 may be configured as another cam mechanism to transfer the linear motion of the actuator sleeve 350 to a rotary motion of the elevator rings 330 through the actuator pins 335. In one or more embodiments, the grooves 351 may be angled from the longitudinal or y-axis 301 such that linear motion of the actuator sleeve 350 translates into rotary motion of the elevator rings 330 through connection with the actuator pins 335. In certain embodiments, the angles of the grooves 351 may be, for example, between approximately 0 degrees and 90 degrees, 0 degrees and 45 degrees, 5 degrees and 30 degrees, or 10 degrees and 20 degrees from a y-axis 301 or the longitudinal axis of the lockdown assembly 300. In embodiments, the grooves 351 having like angles may extend in directions different from each other. In embodiments, the grooves 351 may have angles that are different from each other. The grooves 351 may have any angle and/or direction suitable to translate a linear motion (e.g., along the vertical axis 301) of the actuator sleeve 350 into a rotary motion (e.g., in the angular direction 303) of at least one of the elevator rings 330.

In embodiments, the lock ring 340 may include one or more protrusions or teeth 341 that are configured to engage the interior of an outer housing, such as the wellhead housing 13 (FIG. 1). In one or more embodiments, the lock ring 340 may be configured to be adjusted into locking engagement with the interior of an outer housing, for example the wellhead housing 13. The lock ring 340 also may include a slot 343 that allows the lock ring 340 to expand in outer dimension or diameter as the actuator sleeve 350 is positioned between the internal body 320 and the lock ring 340. In one or more embodiments, the lock ring 340 may include a split lock ring.

Figure 3:
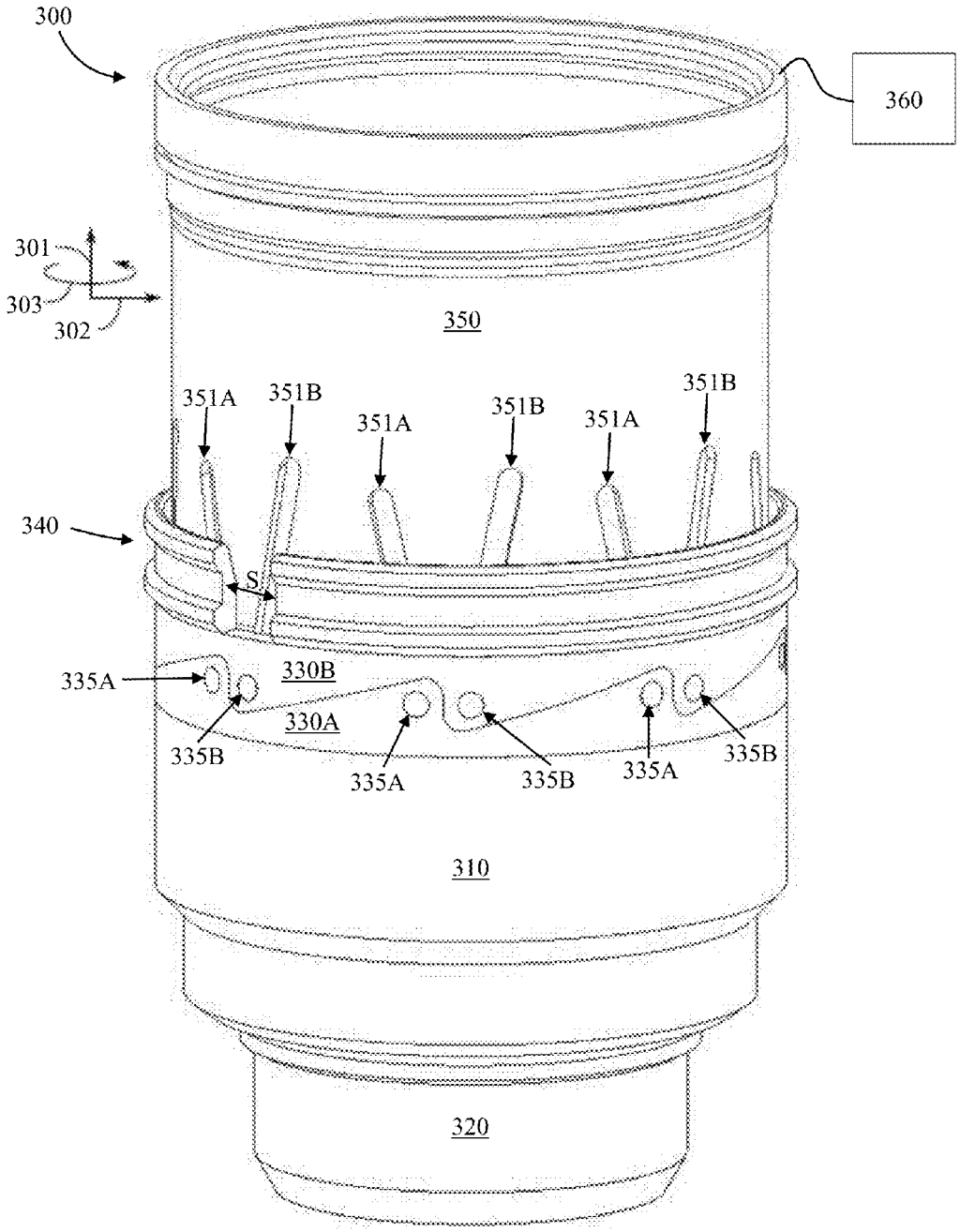
FIG. 3 depicts an axonometric view of a lockdown assembly with the lock ring of FIG. 2 in an expanded position, according to one or more embodiments of the present disclosure.

FIG. 3 shows the actuator sleeve 350 according to one or more embodiments, post initial actuation, i.e., when the actuator sleeve 350 is positioned in part between the internal body 320 and the lock ring 340. As an example operation, the actuator sleeve 350 is moved (e.g., in a downward stroke) between the internal body 320 and the lock ring 340, in a direction toward the support sleeve 310. As the actuator sleeve 350 is moved closer to the support sleeve 310, the actuator sleeve 350 expands the lock ring 340 by a predetermined spacing S.

The lock ring 340 may have any exterior shape that expands with the insertion of the actuator sleeve 350 into the lock ring 340. Thus, the exterior shape of the lock ring 340 may form, as non-limiting examples, a cylinder, a hexagonal prism, a rectangular prism, a triangular prism, a shape having an irregular cross-section and/or multiple outer dimensions, and/or any other shape suitable to engage and/or apply a preload to an interior surface of the outer housing. As used herein, preload refers to the force or forces applied to the lock ring 340 and transferred to the interior surface of the outer housing while the lock ring 340 is installed in locking engagement with the outer housing.

In FIG. 3, the grooves 351 of FIG. 2 are illustrated as the grooves 351A, 351B. In certain embodiments, the grooves 351A on the actuator sleeve 350 are aligned to receive the actuator pins 335A on the elevator ring 330A, while the grooves 351B on the actuator sleeve 350 are aligned to receive the actuator pins 335B on the elevator ring 330B. Thus, the grooves 351A, 351B can be angled to control the respective rotation of the elevator rings 330A, 330B.

The grooves 351A, 351B may both be angled from the y-axis 301 or longitudinal axis of the lockdown assembly 300 to rotate the elevator rings 330A, 330B in opposing directions as the actuator pins 335A, 335B are engaged. That is, the elevator ring 330A may rotate in an opposite direction relative to the angular direction 303, and the elevator ring 330B may rotate in the angular direction 303 about the longitudinal axis of the lockdown assembly 300. In certain embodiments, the angles of the grooves 351A, 351B may be, for example, between approximately 0 degrees and 90 degrees, 0 degrees and 45 degrees, 5 degrees and 30 degrees, or 10 degrees and 20 degrees from a y-axis 301 or the longitudinal axis of the lockdown assembly 300. In embodiments, the grooves 351 may have any angle suitable to translate a linear motion (e.g., along the vertical axis 301) of the actuator sleeve 350 into a rotary motion (e.g., in the angular direction 303) of at least one of the elevator rings 330. In embodiments, the grooves 351A and 351B may have the same or similar angles that extend in directions different from each other.

The grooves 351A, the grooves 351B, and/or the grooves 351A and 351B may have angles that are different from each other. In embodiments, all of the grooves 351A and 351B are angled to control the rotation of the corresponding elevator rings, 330A and 330B, respectively. In embodiments, only the grooves 351A or the grooves 351B are angled for such control. For example, the grooves 351A that receive the actuator pins 335A may be angled to align with the longitudinal axis of the lockdown assembly 300 (e.g., 0 degrees from the y-axis 301 or vertical direction), while the grooves 351B that receive the actuator pins 335B may be angled from y-axis 301 or the longitudinal axis of the lockdown assembly 300 (e.g., greater than 0 degrees to 90 degrees from the y-axis 301 or vertical direction) to rotate elevator ring 330B relative to the elevator ring 330A as the actuator sleeve 350 is moved along the longitudinal axis. Alternatively, the grooves 351A may be angled from the longitudinal axis of the lockdown assembly 300 (e.g., greater than 0 degrees to 90 degrees from the y-axis 301 or vertical direction) to rotate elevator ring 330A relative to elevator ring 330B as the actuator sleeve 350 is moved along the longitudinal axis, while the grooves 351B may be aligned with the longitudinal axis of the lockdown assembly 300.

Figure 4:
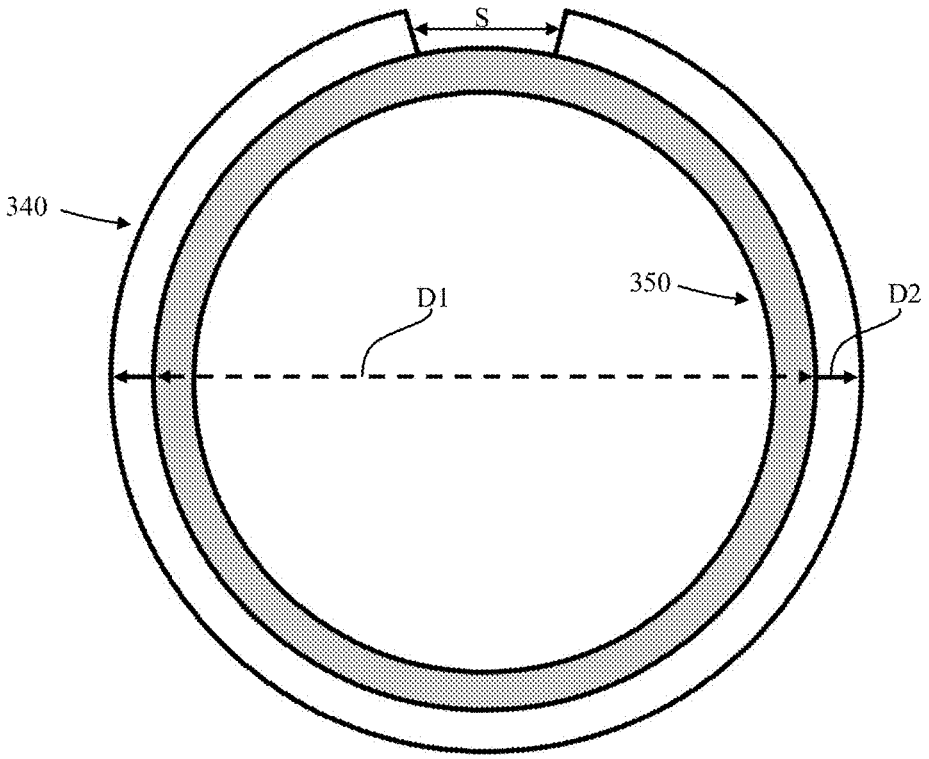
FIG. 4 depicts a cross-sectional schematic of an actuator sleeve expanding the lock ring of FIG. 2, according to one or more embodiments of the present disclosure.

FIG. 4 shows a cross-section of the actuator sleeve 350 expanding the lock ring 340, in accordance with one or more embodiments of the present disclosure. The actuator sleeve 350 may include an outer diameter D1 configured to adjust an outer diameter D2 of the lock ring 340 upon relative movement of the actuator sleeve 350. The expansion of the lock ring 340 allows the lock ring 340 to couple with or otherwise engage an interior surface of the outer housing (e.g., wellhead housing 13) and apply a preload to it. The predetermined spacing S may be a spacing selected to increase the outer dimension (diameter D2) of the lock ring 340 so that it can engage with an interior surface of any suitable outer housing, such as the wellhead housing 13 (FIG. 1).

Figure 5:
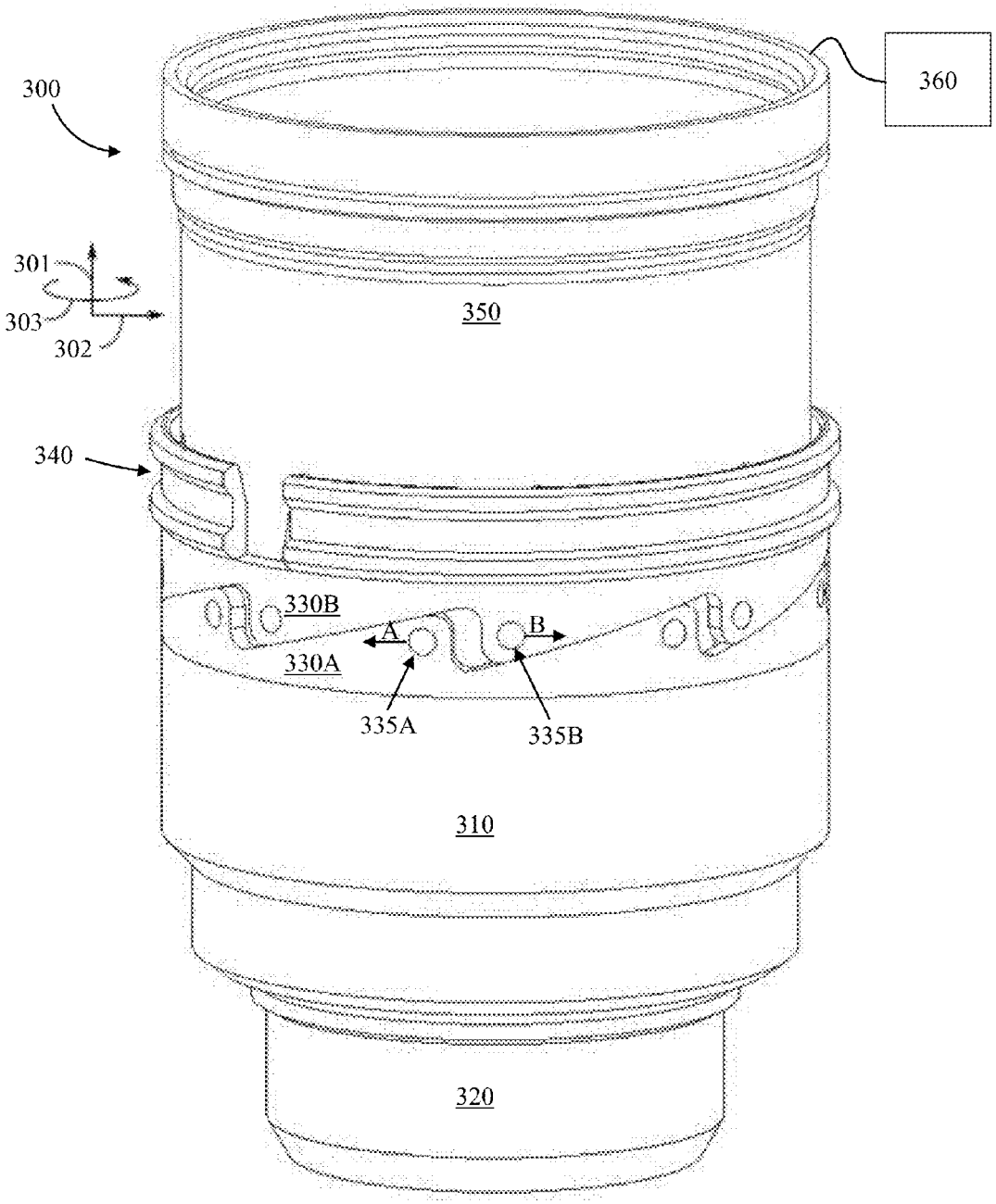
FIG. 5 depicts an axonometric view of a lockdown assembly axially positioning the lock ring of FIG. 2, according to one or more embodiments of the present disclosure.
Figure 6:
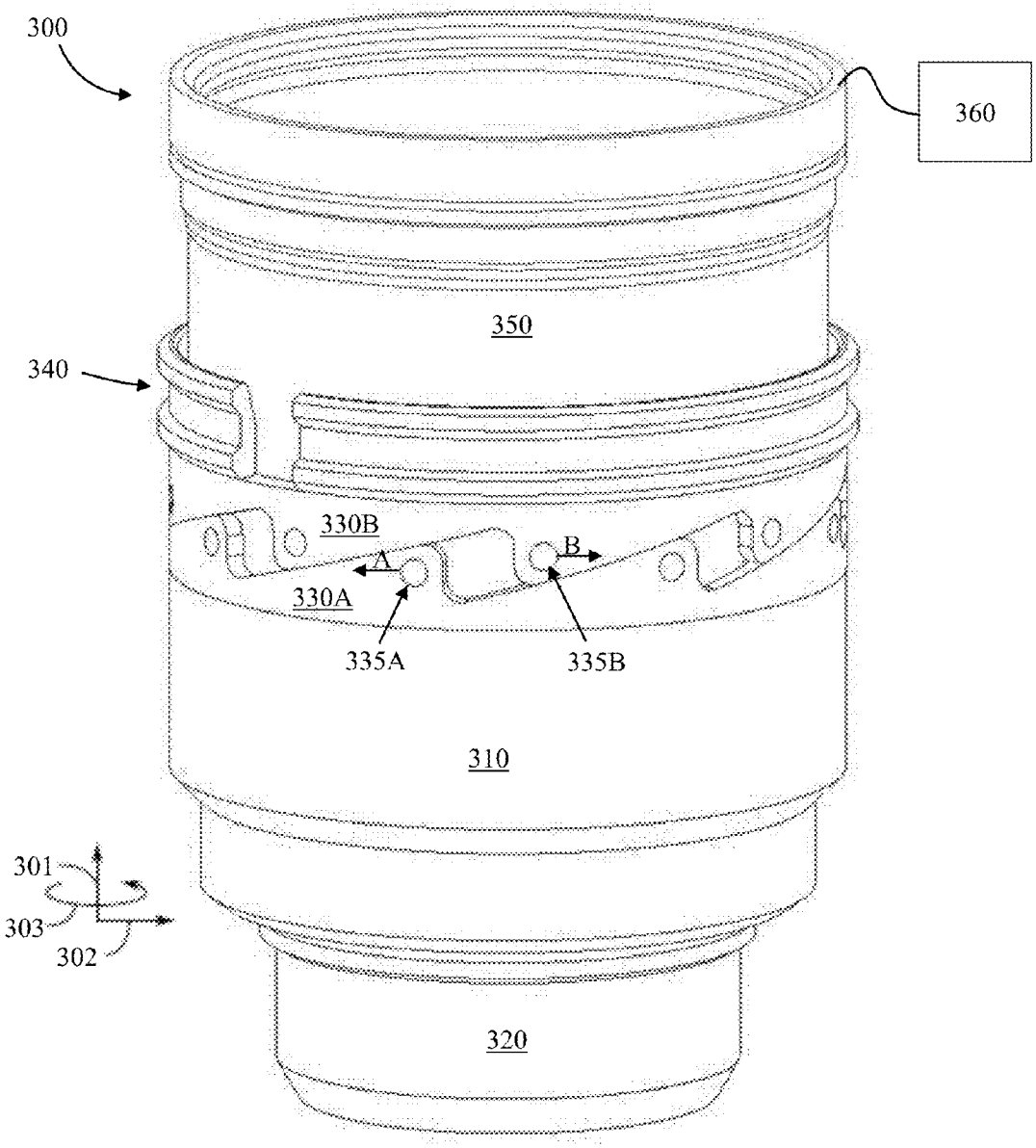
FIG. 6 depicts an axonometric view of a lockdown assembly with the lock ring of FIG. 2 in an expanded and axially positioned state and engaging the interior of a housing, according to one or more embodiments of the present disclosure.

FIGS. 5 and 6 show the rotation of the elevator rings 330 (330A, 330B) when the grooves 351 (not shown) engage the pins 335 (335A, 335B) and the axial movement of the lock ring 340 away from the support sleeve 310, in accordance with one or more embodiments of the present disclosure. As the actuator sleeve 350 is stroked or otherwise moved or positioned between the internal body 320 and the elevator rings 330A, 330B, the grooves 351A, 351B (see FIG. 3) engage with the actuator pins 335A, 335B respectively. The grooves 351A, 351B can be angled to move the elevator rings 330A, 330B in the directions indicated by arrows A, B respectively. In particular, still referring to FIGS. 5 and 6, the actuator pin 335A is received in the groove 351A. As the actuator pin 335A follows the path of groove 351A (see, e.g., FIG. 3) caused by the downward movement of the actuator sleeve 350, the elevator ring 330A is moved in the direction indicated by arrow A (i.e., in an opposite direction to illustrated angular direction 303). Likewise, as the actuator pin 335B follows the path of groove 351B (see, e.g., FIG. 3), the elevator ring 330B is moved in the opposite direction indicated by arrow B (i.e., in the illustrated angular direction 303).

Referring to FIG. 6, the actuator pins 335A, 335B are received in the grooves 351A, 351B to move the elevator ring 330B away from the support sleeve 310. As a result of the movement of the elevator ring 330B, the lock ring 340 is also moved away from the support sleeve 310 to securely engage the lock ring 340 with an interior surface of any suitable outer housing, such as the wellhead housing 13 of FIG. 1. As illustrated in FIG. 6, the lockdown assembly 300 is in a position to securely engage the lock ring 340 with the interior of a housing.

FIGS. 7-10 show a cross-section of the lockdown assembly 300 at various positions in the wellhead housing 13 to adjust the spacing between the lock ring 340 and the support sleeve 310, in accordance with one or more embodiments. Adjusting this spacing allows the hanger 25 to be engaged and/or preloaded without running a measurement tool into the wellhead housing 13 before running the lockdown assembly 300. Instead, in a single run the lockdown assembly 300 may be run into the wellhead housing 13, and the height of the lockdown assembly 300 may be adjusted inside the wellhead housing 13 to apply a preload with the lock ring 340.

Figure 7:
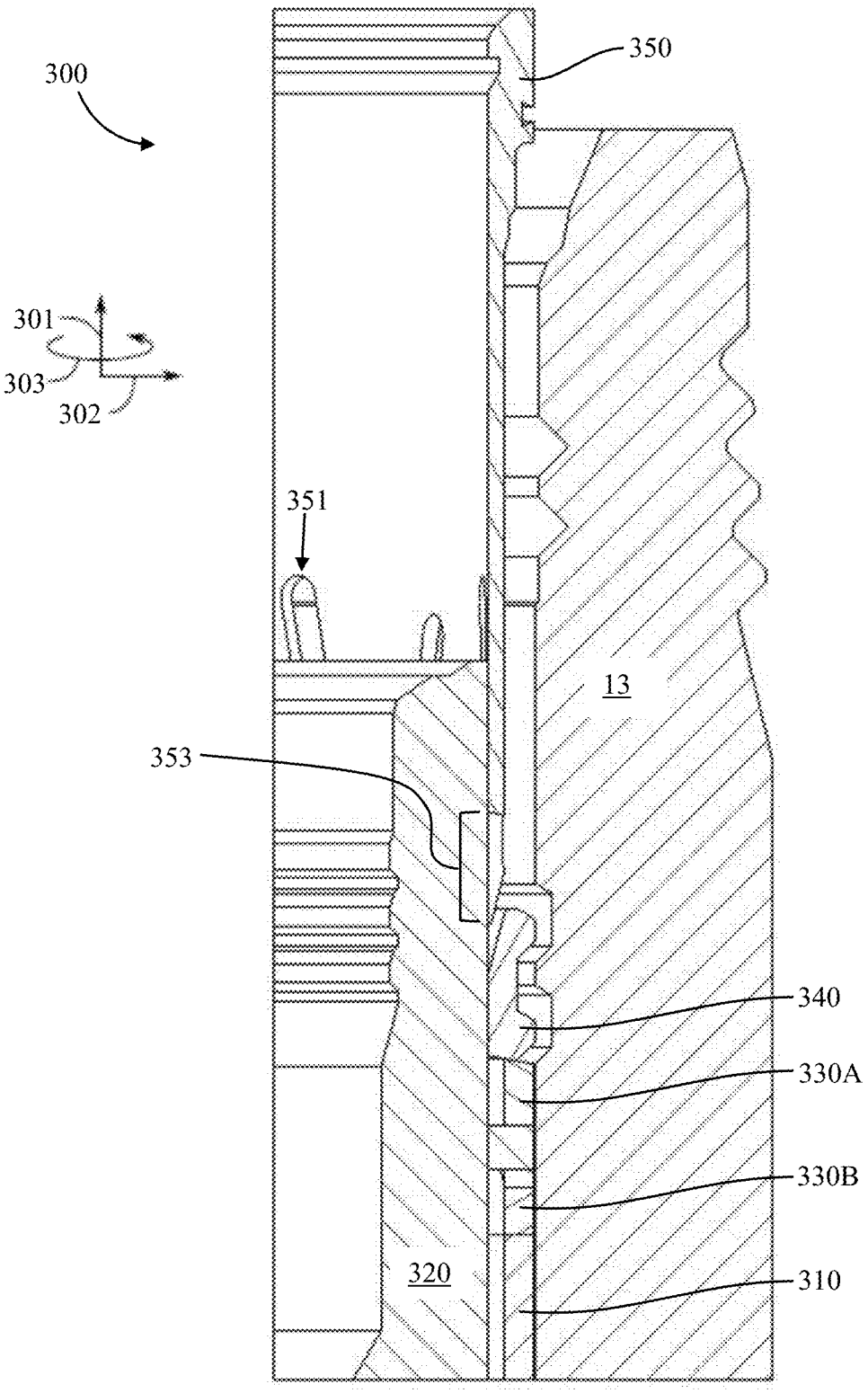
FIG. 7 depicts a cross-section of the lockdown assembly of FIG. 2 in a housing, according to one or more embodiments of the present disclosure.

FIG. 7 shows the actuator sleeve 350 positioned above the lock ring 340 and between the internal body 320 and the wellhead housing 13. As illustrated, the lock ring 340 is disengaged from the wellhead housing 13. The actuator sleeve 350 may have a profile 353 that increases in outer dimension enough to expand the lock ring 340 by the predetermined spacing S (FIGS. 3-4) as the actuator sleeve 350 is stroked or otherwise moved or positioned between the lock ring 340 and the internal body 320. In particular, the actuator sleeve 350 may increase in outer dimension along at least a portion of the profile 353. In one or more embodiments, at least a portion of the actuator sleeve 350 may have an increased outer dimension (e.g., diameter D1 of FIG. 4) that is enough to expand the lock ring 340 to an expanded outer dimension (e.g., diameter D2 of FIG. 4) by the predetermined spacing S (FIGS. 3-4).

Figure 8:
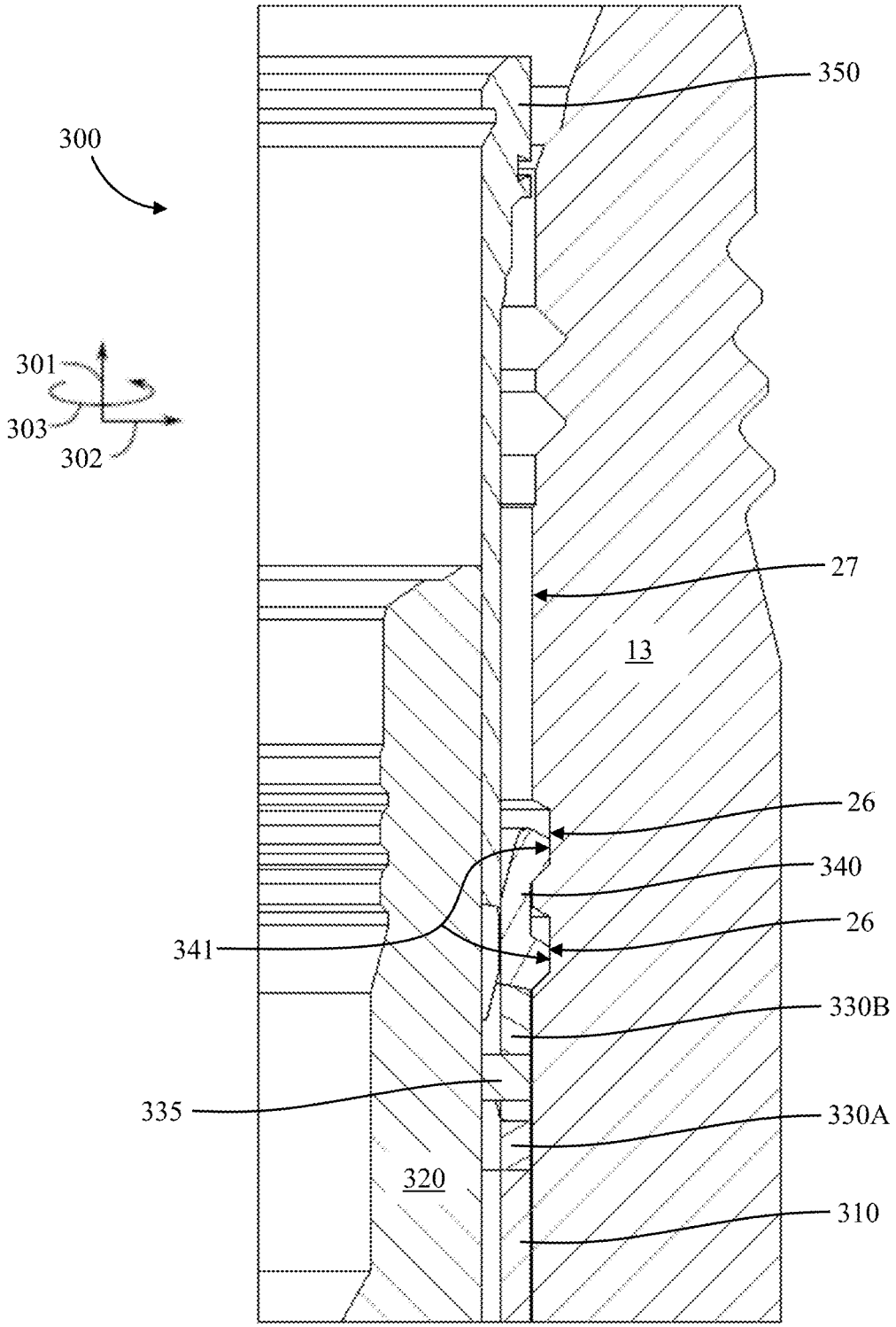
FIG. 8 depicts a cross-section of the lock ring of FIG. 2 in an expanded position, according to one or more embodiments of the present disclosure.

FIG. 8 shows the actuator sleeve 350 after moving axially between the lock ring 340 and the internal body 320 in a downward direction such that the lock ring 340 is radially expanded. In one or more embodiments, the wellhead housing 13 may have one or more recesses 26 on its interior surface 27 (e.g., the interior wall of the wellhead housing 13). The recesses 26 may be configured to receive the protrusions or teeth 341 on the lock ring 340. The protrusions or teeth 341 may be configured to engage the recesses 26 in the wellhead housing 13.

Figure 9:
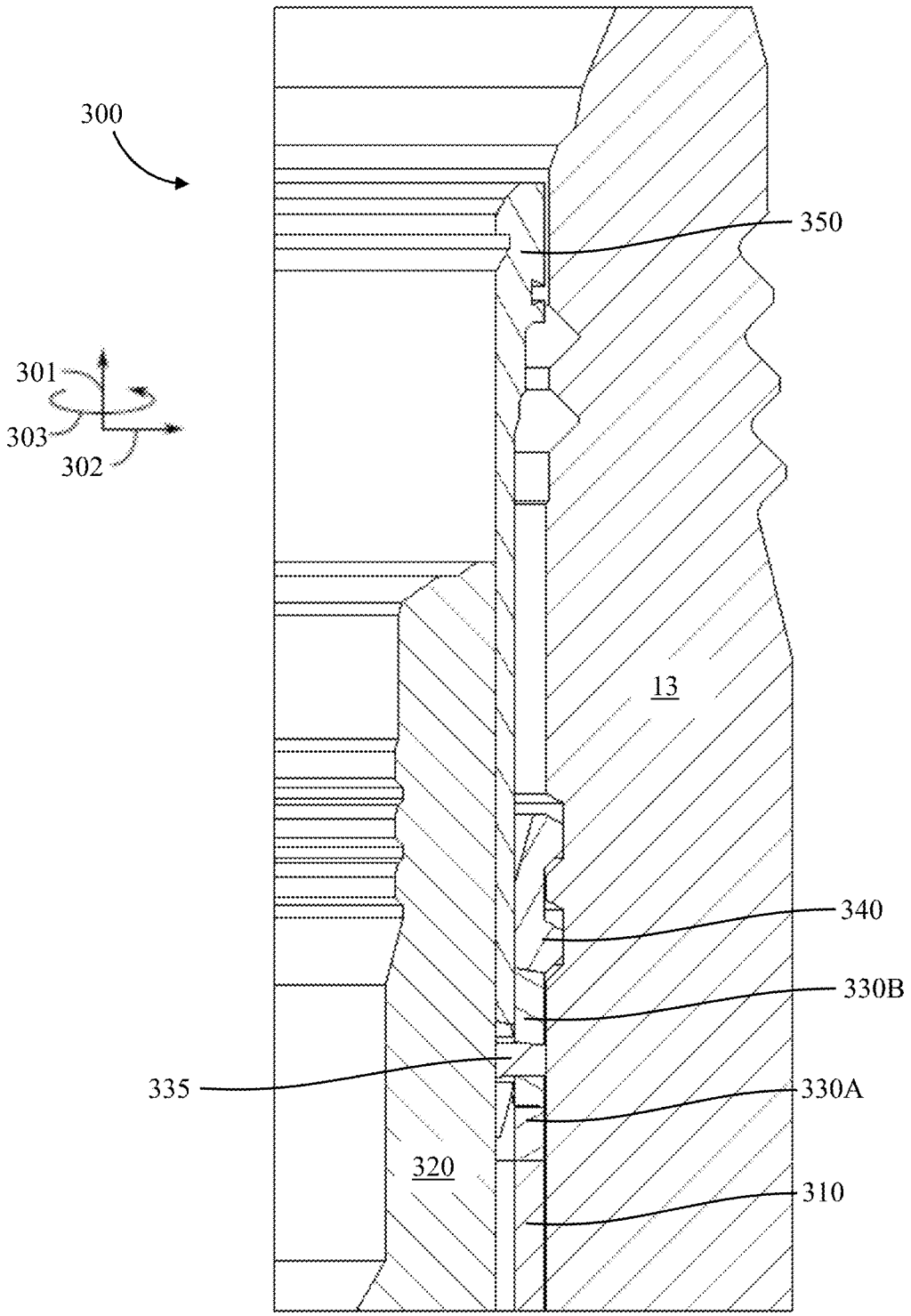
FIG. 9 depicts a cross-section of a lockdown assembly axially positioning the lock ring of FIG. 2, according to one or more embodiments of the present disclosure.

FIG. 9 shows the actuator sleeve 350 after moving axially between the elevator rings 330A, 330B and the internal body 320. The grooves 351 (FIG. 2) are engaged with the actuator pins 335 on the elevator rings 330A, 330B to rotate the elevator rings 330A, 330B relative to each other. The rotation of the elevator rings 330A, 330B causes the lock ring 340 to move away from the support sleeve 310. The lock ring 340 is raised, relative to the support sleeve 310, axially opposite the direction of the actuator sleeve 350 by rotating the elevator rings 330A, 330B with the axial movement of the actuator sleeve 350.

Figure 10:
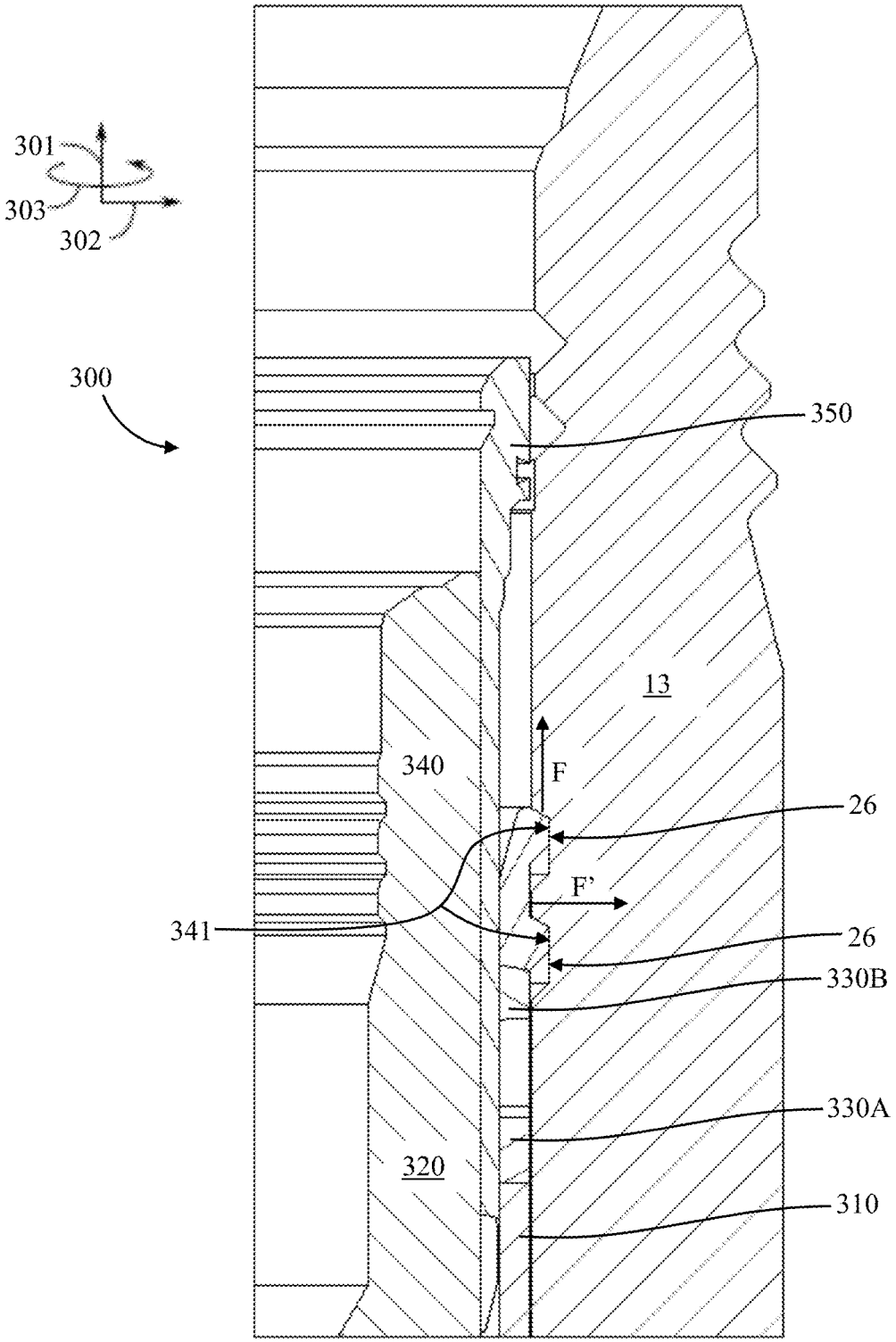
FIG. 10 depicts a cross-section of a lockdown assembly with the lock ring in an expanded and axially positioned state and engaging the wellhead housing of FIG. 7, according to one or more embodiments of the present disclosure.

FIG. 10 shows one or more embodiments in which the protrusions or teeth 341 of the lock ring 340 are configured to engage with the recesses 26 in the wellhead housing 13. The actuator sleeve 350 may continue to move axially to rotate the elevator rings 330A, 330B such that the elevator rings 330A, 330B secure the lock ring 340 into the recesses 26 in the wellhead housing 13. As the elevator ring 330B rotates about the vertical axis 301 and on the cams 331 (FIG. 2) of the elevator ring 330A, the elevator ring 330B moves away from the support sleeve 310. As a result of the movement of the elevator ring 330B, the lock ring 340 is also moved into a locking engagement with the recesses 26 in the wellhead housing 13. In embodiments, such locking engagement may include application of one or more preloads F, F', in one or more directions, e.g., an axial direction such as of the y-axis 301 and/or a radial direction such as of the x-axis 302, to an interior surface of the wellhead housing 13.

In one or more embodiments of the present disclosure, a method may be performed to install the lockdown assembly 300 (FIG. 2) in a housing (e.g., the wellhead housing 13 of FIG. 1). The actuator sleeve 350 may be powered by the power supply 360 to move axially in a downward direction between the lock ring 340 and the internal body 320. One or more groove(s) 351 on the actuator sleeve 350 may be aligned to receive one or more actuator pins 335 on an elevator ring 330. A groove 351 on the actuator sleeve 350 may receive and engage a pin 335 on an elevator ring 330. The groove 351 may be angled to guide a rotation of the elevator ring 330 during the axial movement of the actuator sleeve 350. The elevator ring 330 may rotate as the pin 335 follows the groove 351 translating the axial movement of the actuator sleeve 350 to a rotary movement of the elevator ring 330. In one or more embodiments, the elevator ring 330 may rise in an upward direction as a cylindrical follower (e.g., the follower 333 of FIG. 2) on the elevator ring 330B moves along a cylindrical cam (e.g., the cam 331 of FIG. 2) on the elevator ring 330A. The lock ring 340 may rise in an upward direction by the rotation of the elevator ring 330B produced from the axial movement of the elevator ring 330B. In embodiments, the actuator sleeve 350 may continue to move in the downward axial direction to expand and raise the lock ring 340 into locking engagement with the housing (e.g., wellhead housing 13 of FIG. 1).

Upon retrieval of the lockdown assembly 300, the actuator sleeve 350 is pulled upward by the power supply 360, forcing the elevator rings 330A, 330B to rotate in opposite directions relative to their rotational directions when the actuator sleeve 350 moves downward, which in turn, allows the lock ring 340 to eliminate, or reduce in part, any preload applied to the interior surface of the wellhead housing 13. Continued pulling of the actuator sleeve 350 upward can provide the radial space for the lock ring 340 to retract back to an un-expanded position, for example, the positions depicted in FIGS. 2 and 7, and lower downward in increasing proximity to the support sleeve 310.

As one skilled in the art will appreciate, the lockdown assembly 300 is not limited to being used as a lockdown and/or preloading mechanism for casing hangers in a wellhead housing. The support sleeve 310 may be coupled to or otherwise engaged with any suitable hanger (e.g., casing hangers 25, tubing hangers, hangers for other tubulars, or the like). For example, the lockdown assembly 300 may be used to preload one or more tubing hangers to the interior of a wellhead housing, a tree, a spool, a casing, or other body exterior to the tubing hanger. The lockdown assembly 300 may also be used as a lockdown device between other devices with coaxial, cylindrical bores. The support sleeve 310 may be configured to couple with or otherwise engage any suitable tubular or housing, and likewise, the lock ring 340 may be configured to engage an interior surface or wall of any suitable tubular or housing. In embodiments, the lockdown assembly 300 may be used as a lockdown device on seal assemblies for casing hangers or tubing hangers, or on the hangers themselves. In embodiments, the lockdown assembly 300 may be used as a lockdown device on tie-back applications. In embodiments, the lockdown assembly 300 may be used as a preloading mechanism between a wellhead housing and a conductor housing. Accordingly, it will be appreciated that the lockdown assembly 300 can be used in wellheads, trees, spools, tie-back applications, etc. In these applications, the mechanisms described herein can be used to engage an inner body to an outer body and may have an applied preload.

In one or more embodiments, the lockdown assembly 300 may include one or more cylindrical cams, such as the cams 331 positioned on the elevator ring 330A, and one or more followers each configured to engage a cylindrical cam, such as the followers 333 on the elevator ring 330B. The cylindrical cam may be integral with the support sleeve 310 or with a separate elevator ring 330 (e.g., the elevator ring 330A may serve as the cylindrical cam). In addition, the follower may be integral with the lock ring 340 or with another elevator ring 330 (e.g., the elevator ring 330B may serve as the follower). The lock ring 340 may be configured to move with the follower engaged with the cylindrical cam, and/or the actuator sleeve 350 may be configured to be received in the lock ring 340 and the follower.

In one or more embodiments, the lockdown assembly 300 may include a single elevator ring 330 located between and coaxially with the support sleeve 310 and the lock ring 340. In these embodiments, the support sleeve 310 may include one or more cams 331 that mate with the followers 333 on the elevator ring 330, or the lock ring 340 may include followers 333 that are configured to transform rotary motion into linear motion along the y-axis 301 or the longitudinal axis of the lockdown assembly 300.

In embodiments, the elevator ring 330A may be integral with the support sleeve 310, and/or the elevator ring 330B may be integral with the lock ring 340 with the split 343. Further, the cams 331 and the followers 333 may be positioned on the surfaces of the support sleeve 310 and the lock ring 340 that mate with each other. In embodiments, the lockdown assembly 300 may include more than two elevator rings 330 to adjust the spacing between the lock ring 340 and the support sleeve 310.

Reference throughout this specification to "one embodiment," "an embodiment," "embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Although the present disclosure has been described with respect to specific details, it is not intended that such details should be regarded as limitations on the scope of the invention, except to the extent that they are included in the accompanying claims.

What is claimed is:

1. A well system, comprising:

a housing; and a lockdown assembly engageable with a tubular hanger and an interior of the housing, comprising:

a support sleeve;

a body received in the support sleeve;

an elevator ring engaged with the support sleeve;

a lock ring engaged with the elevator ring; and an actuator sleeve configured to move axially between the body and the elevator ring so as to adjust the position of the lock ring, wherein the actuator sleeve is moveable between the body and the lock ring.

2. The well system of claim 1, wherein the actuator sleeve comprises a groove configured to receive a pin positioned on the elevator ring.

3. The well system of claim 2, wherein the groove is angled between about 5 degrees and about 50 degrees from a longitudinal axis of the body.

4. The well system of claim 1, wherein the elevator ring comprises a pin positioned to engage the actuator sleeve.

5. The well system of claim 1, wherein the lock ring comprises a split lock ring, and the tubular hanger is landable in the housing.

6. The well system of claim 1, wherein the lock ring is configured to be adjusted into locking engagement with the interior of the housing.

7. The well system of claim 1, wherein the actuator sleeve includes a first outer diameter configured to adjust a second outer diameter of the lock ring upon relative movement of the actuator sleeve.

8. The well system of claim 1, further comprising an additional elevator ring located between the support sleeve and the elevator ring.

9. The well system of claim 8, wherein the additional elevator ring comprises a cam configured to mate with a follower positioned on the elevator ring.

10. The well system of claim 8, wherein the actuator sleeve comprises grooves configured to receive pins positioned on the elevator ring and the additional elevator ring.

11. A method of installing a lockdown assembly in a wellhead housing, comprising:

moving an actuator sleeve axially between a lock ring and a body in a first direction so as to radially expand the lock ring;

raising the lock ring axially opposite the first direction by rotating an elevator ring with the axial movement of the actuator sleeve; and continuing to move the actuator sleeve to expand and raise the lock ring into locking engagement with the wellhead housing.

12. The method of claim 11, wherein raising the lock ring comprises moving the elevator ring along a cylindrical cam.

13. The method of claim 11, wherein raising the lock ring comprises receiving a pin on the elevator ring in a groove on the actuator sleeve.

14. The method of claim 13, wherein raising the lock ring comprises rotating the elevator ring by translating the axial movement of the actuator sleeve to a rotary movement of the elevator ring through the pin on the elevator ring following the groove on the actuator sleeve.

15. A lockdown assembly, comprising:

a cylindrical cam;

a follower engaged with the cylindrical cam;

a lock ring configured to move with the follower; and an actuator sleeve configured to move axially in the lock ring and the follower so as to adjust the position of the lock ring, wherein the actuator sleeve comprises a groove configured to receive a pin positioned on at least one of (a) the cylindrical cam and (b) the follower.

16. The lockdown device of claim 15, wherein the lock ring is configured to be adjusted into locking engagement with an interior of a housing.

17. The lockdown device of claim 15, wherein the groove is angled to rotate at least one of (a) the cylindrical cam and (b) the follower from the axial movement of the actuator sleeve.

* * * * *